US006526683B1

(12) United States Patent
Crandall

(10) Patent No.: US 6,526,683 B1
(45) Date of Patent: Mar. 4, 2003

(54) MID-GRIP HIGH-POWER PISTOL

(75) Inventor: N. Eugene Crandall, 8007 W. Buckskin Rd., Pocatello, ID (US) 83201

(73) Assignee: N. Eugene Crandall, Pocatello, ID (US)

( * ) Notice: Subject to any disclaimer, the term of this patent is extended or adjusted under 35 U.S.C. 154(b) by 0 days.

(21) Appl. No.: 09/785,568

(22) Filed: Feb. 16, 2001

(51) Int. Cl.[7] ..... F41C 23/10

(52) U.S. Cl. ..... 42/40; 42/71.02; 42/75.01; 42/75.03; 42/75.04

(58) Field of Search ..... 42/40, 71.02, 75.01, 42/75.03, 75.04, 72

(56) References Cited

U.S. PATENT DOCUMENTS

| | | | | |
|---|---|---|---|---|
| 1,307,594 A | | 6/1919 | Newman | |
| 1,405,321 A | * | 1/1922 | Peterson | 42/136 |
| 2,832,166 A | | 4/1958 | Ivy | |
| 3,188,763 A | * | 6/1965 | Duncan | 42/16 |
| 4,242,826 A | | 1/1981 | Anschütz | |
| 4,358,986 A | * | 11/1982 | Giorgio | 89/1.4 |
| 4,601,123 A | | 7/1986 | Swearengen et al. | |
| 4,663,876 A | | 5/1987 | Reaume | |
| 4,677,781 A | | 7/1987 | Lee | |
| 4,869,008 A | | 9/1989 | Rasmussen | |
| 5,225,610 A | * | 7/1993 | Uria | 42/40 |
| 5,448,940 A | * | 9/1995 | Schuetz et al. | 89/128 |
| 5,722,195 A | * | 3/1998 | Bentley et al. | 42/1.06 |

OTHER PUBLICATIONS

De Haas, Frank, "Good Pistols from Cheap Rifles", The American Rifleman, May 1943.*

Takedown Leverguns, Guns & Ammo. Nov. 1985. vol. 29; p. 74.

The Dominator Bolt–Action Powerhouse, Guns & Ammo. Apr. 1985, vol. 29; p. 44.

* cited by examiner

*Primary Examiner*—Charles T. Jordan
*Assistant Examiner*—John W. Zerr
(74) *Attorney, Agent, or Firm*—Morriss, Bateman, O'Bryant & Compagni

(57) ABSTRACT

A system and method for manufacturing a mid-grip high-powered pistol by modifying an existing rifle receiver, wherein a portion of the original trigger is removed, a new trigger is added in a position forward of the partially removed original trigger, and the new trigger is coupled to the remaining portion of the original trigger via an extension, wherein a recoil lug is added to the rifle receiver to handle the recoil, a plurality of different length barrels can be coupled to the new pistol, and a pivot pin diameter and location of a forearm lug prevent creation of an illegal rifle.

32 Claims, 8 Drawing Sheets

MID-GRIP HIGH-POWER PISTOL

BACKGROUND

1. The Field of the Invention

This invention relates generally to firearms that are converted from an original form to provide a new function as a different type of firearm. Specifically, the invention is a rifle receiver that is modified to be a high quality mid-grip high-powered pistol, capable of accepting barrels of various calibers, incorporating a recoil plug as part of the design to thereby handle the greater action of the pistol, and creation of a pistol stock and forearm stock that enables the pistol to function properly.

2. The State of the Art

A new group of handguns has been created for use in hunting big game and for long range target competition. These handguns or high-powered pistols are essentially single-shot or repeating rifles with shortened barrels and buttstock, and are capable of delivering rifle energies.

The state of the prior art of high-powered pistols is divided into two groups. The first group consists of pistols that are directly manufactured as such. The second groups consists of pistols that are created as a result of a retro-fit or modification of other firearms which results in the creation of the pistol. It is noted that regardless of which group a high-powered pistol comes from, the performance or attributes can vary greatly depending upon the specific features that are incorporated into the design.

Whether a user is going to use a high-powered pistol for game hunting or target competition, there are certain desirable attributes that are common to each purpose. Obviously, accuracy is of paramount concern. Beyond this particular attribute, however, there can be significant differences in functionality. For example, the user may desire a particular type of action. The possible types of action of high-powered pistols include lever action, break action, bolt action, and falling block.

Creating a retrofit high-powered pistol is typically done to bring some characteristics of the original firearm to the design, provide a particular action, or to create a unique firearm. Regardless of the purpose, the retrofit is generally done to bring some advantageous or desirable feature to a firearm.

Accordingly, it would be an advantage over the prior art to provide a low cost pistol having a mid-grip design, a single action, and the ability to exchange barrels of various lengths and calibers as desired. It would be another advantage over the prior art to provide these features in a high-powered pistol that utilizes a reliable rifle receiver that is well-known and proven design in the industry. Furthermore, these advantageous features can be provided on many popular rifle receiver designs.

OBJECT AND SUMMARY OF THE INVENTION

It is an object of the invention to provide a system and method for manufacturing a mid-grip high-powered pistol.

It is another object to modify a rifle receiver to function as the mid-grip high-powered pistol.

It is another object to modify the rifle receiver so as to include a recoil lug.

It is another object to modify the rifle receiver by removing the rifle stock and to add a new pistol stock behind the rifle action.

It is another object to modify the rifle receiver so as to remove a portion of the existing rifle trigger, and then dispose a new trigger in a position that is forward of the removed portion of the old rifle trigger.

It is another object to modify the rifle receiver so as to be capable of receiving a plurality of different length pistol barrels.

It is another object to modify the rifle receiver so as to be capable of receiving a plurality of different pistol barrels of various calibers.

It is another object to modify the rifle receiver so that it cannot use pistol barrels that would result in the creation of an illegal short-barreled rifle.

The above objects are realized in a specific illustrative embodiment of a system and method for manufacturing a mid-grip high-powered pistol by modifying an existing rifle receiver, wherein a portion of the original trigger is removed, a new trigger is added in a position forward of the partially removed original trigger, and the new trigger is coupled to the remaining portion of the original trigger via an extension, wherein a recoil lug is added to the rifle receiver to handle the recoil, a plurality of different length barrels can be coupled to the new pistol, and a pivot pin diameter and location of a forearm lug prevent creation of an illegal rifle.

In accordance with a first aspect of the invention, the rifle receiver is modified so as to receive the recoil lug.

In accordance with a second aspect of the invention, a new rear mounting screw is mounted into a rear portion of the rifle receiver.

In accordance with a third aspect of the invention, a new trigger is coupled to the original trigger via a pivotally engaged bar, and the excess portion of the original trigger is removed.

In accordance with a fourth aspect of the invention, the new trigger is disposed in front of the original trigger.

In accordance with a fifth aspect of the invention, an existing pivot pin is decreased in diameter to prevent pistol barrels from being coupled to the rifle receiver.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

The present invention is the modification of an existing rifle receiver to create a mid-grip high-powered pistol. It is useful to understand the purpose of such a modification before addressing how this is accomplished.

One of the main problems in manufacturing a mid-grip high-powered pistol is the cost. Manufacturing costs are often very dependent upon the quantity of the item that is going to be produced. Speciality weapons such as a mid-grip high-powered pistol of the present invention have a limited market, and thus a purchaser is faced with the dilemma of paying more for this type of firearm when it is tooled to be manufactured. The inventor believed that a suitable low-cost rifle receiver might be capable of being modified at a cost that would be less than the cost of directly manufacturing the mid-grip high-powered pistol. The present invention is the culmination of that effort.

Figure 1:
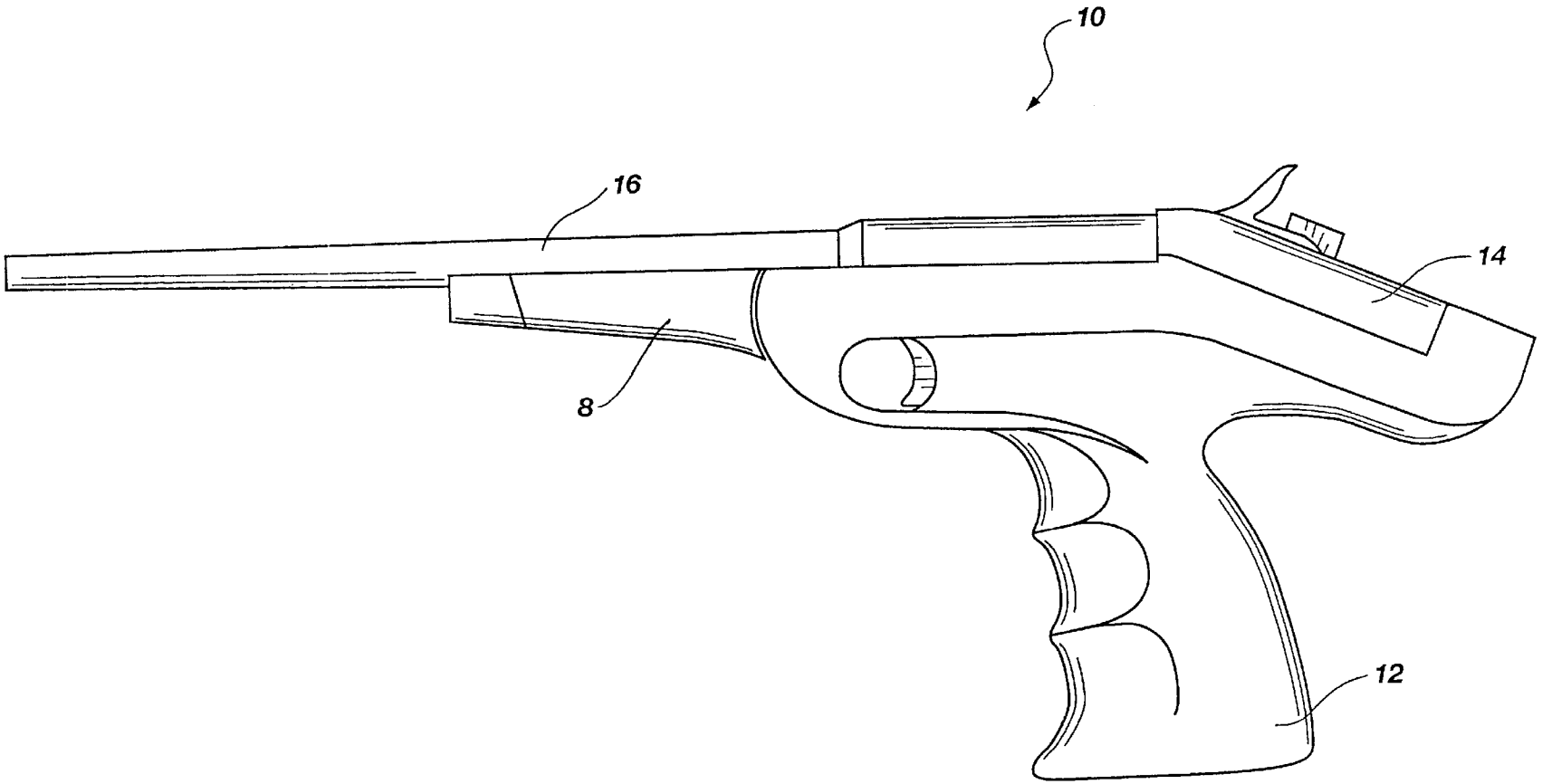
FIG. 1 is a an elevational profile view of the invention which is made in accordance with the principles of the presently preferred embodiment.

FIG. 1 is an elevational profile view of the presently preferred embodiment of the invention. A pistol 10 is shown having a mid-grip stock 12, a portion of a rifle receiver 14 being visible, a barrel 16, and a forearm stock 8. To create this pistol, it is necessary to look at the individual components, and examine how they are assembled.

Figure 2A:
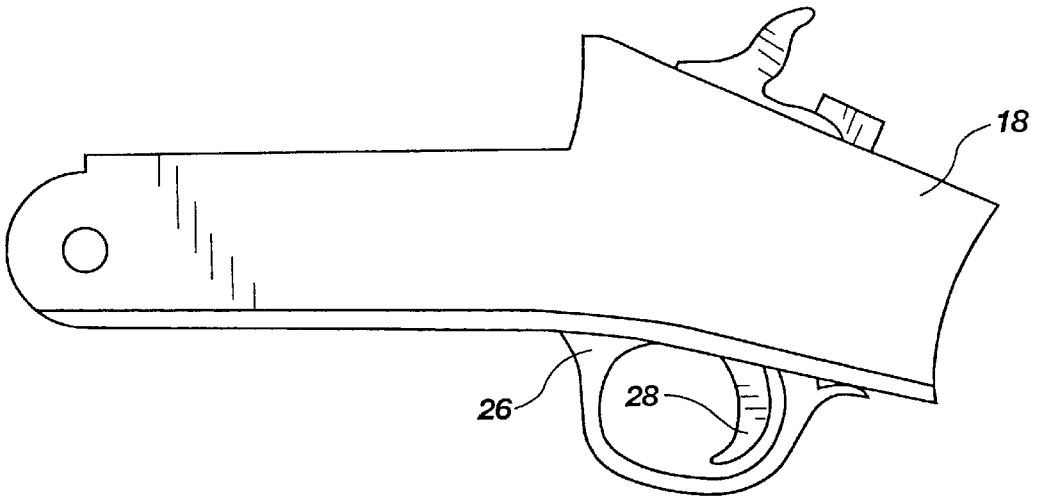
Fig. 2A (PRIOR ART)
FIG. 2A is an elevational profile view of the unmodified rifle receiver of the prior art that is utilized in the present invention.

FIG. 2A is an elevational profile view of an unmodified rifle receiver 18 of the prior art, with the stock removed. It is noted that the rifle receiver 18 that was selected for this embodiment is a mass produced design, has a reliable performance record in the industry, and has a single shot action. The manufacturer of the rifle receiver 18 is New England Firearms of Massachusetts. However, it is an aspect of the invention that any appropriate rifle receiver can be used. What is important is that the rifle receiver be of sufficiently low cost such that making the modifications will result in a pistol that is less expensive to make than one which is tooled and manufactured directly.

Figure 2B:
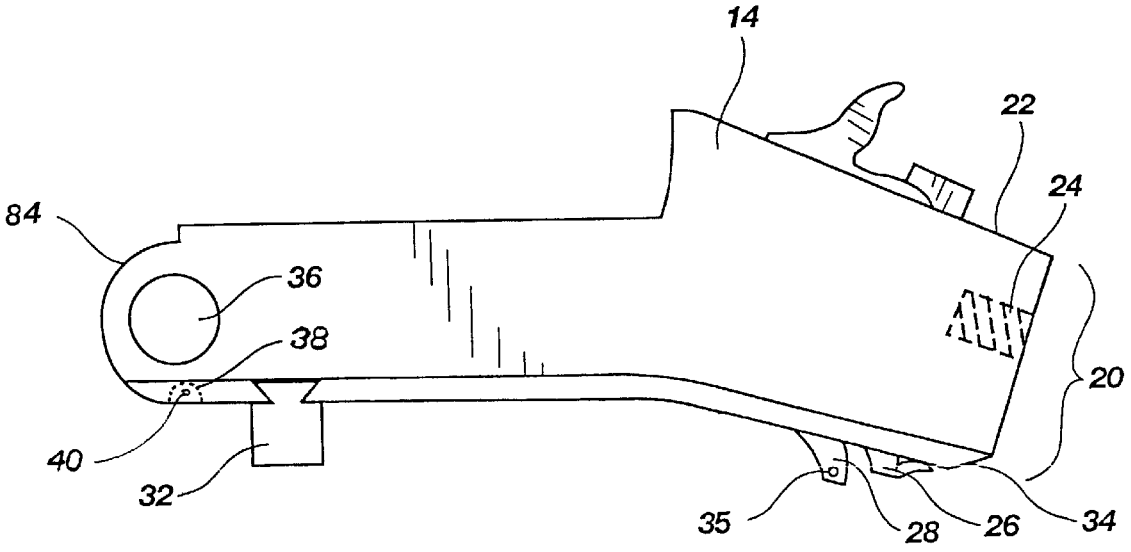
FIG. 2B is an elevational profile view of the rifle receiver of FIG. 2A after it has been modified to function as the receiver for a mid-grip high-powered pistol.

As shown in the presently preferred embodiment of FIG. 2B, one of the modifications that is made to the rifle receiver 18 is to square off the concave rear portion 20 of the receiver relative to a top line 22 thereof. In this embodiment, a wedge-shaped portion 34 of the bottom edge of the receiver 14 is also removed. Not shown is a new rear mounting screw that is used to couple a shorter stock to the receiver 14. The new rear mounting screw is coupled to an existing threaded hole 24.

When adding a new shorter stock, the receiver 14 is glass bedded to the new stock to form a partial recoil area. Advantageously, this new configuration prevents the bottom rear area 34 from splitting the stock under heavy recoil. This design also shortens the length of the wood required behind the action of the receiver 14.

In order to enable placement of the mid-grip stock 12 for the pistol and a new trigger, it is also necessary to remove a portion of the original trigger guard 26, and a portion of the original trigger 28. As much of the original trigger guard 26 should be removed as desired. However, a portion of the original trigger guard 26 is retained because it also functions as a spacer inside the rifle receiver. Therefore, the portion of the original trigger guard 26 that is outside of the rifle receiver is removed. This may not be necessary with all rifle receivers that could be modified to become a pistol.

The original trigger 28 is modified by cutting most of it off. The portion that remains is only left there so that there is something that can be attached to and still actuate it. In other words, the original trigger 28 still causes the receiver to fire, so a means has to be provided for actuating the original trigger 28 from the position of a new trigger. In this preferred embodiment, the means selected to do this requires that the original trigger 28 be cut off, slotted, and a hole disposed therethrough. Accordingly, the original trigger 28 needs to have a portion of metal removed so that a new extension bar can slide up into and between the remaining portions of the original trigger 28. Finally, a hole 35 is drilled through the original trigger. The hole 35 passes through the new slotted portion in the original trigger 28. More detail will be provided when the new trigger assembly is explained.

One of the most novel aspects of the invention is the addition of a recoil lug 32. A recoil lug is not generally found on a pistol because typical pistol energy is not as great as that of a rifle. But the old rifle stock has been removed. Therefore, this feature was found to be critical in the performance of the invention because of the rifle energies that the pistol can deliver. Without it, the recoil is too great to allow for consistently accurate shooting. The greater recoil of the pistol could even result in harm to the user.

Not only was the addition of the recoil lug 32 necessary, but its placement along the receiver 14 is just as important. Specifically, the space between a recoil area at the end of the rifle receiver should be spaced as far from the recoil lug 32 as possible. The greater the space between them, the greater the reduction in recoil.

In the presently preferred embodiment, the recoil lug 32 is disposed as far forward as possible along the rifle receiver 14, without interfering with a new trigger. In the presently preferred embodiment, the recoil lug 32 is disposed just behind a new trigger assembly. In this position, the recoil lug 32 also functions to guide an extension bar of the new trigger assembly, as will be shown.

In the presently preferred embodiment, the means for attaching the recoil lug 32 to the receiver 14 is going to require that the receiver be modified. In a present embodiment, a dove-tail is cut into the receiver 14 because it was a simple procedure. The recoil lug 32 is cut so as to fit into the dove-tail. However, it is envisioned that a preferred embodiment will couple the recoil lug 32 to the receiver 14 either by forging or welding. Likewise, the recoil lug 32 could also be attached by a screw.

Another modification of the receiver 14 is a pivot pin 36. Specifically, the diameter of the new pivot pin 36 is changed. Changing the diameter has an important affect on the use of the pistol. The pistol will not be capable of interchanging rifle barrels for pistol barrels. This is important in order to prevent a user from creating a rifle that violates Federal laws. It is noted that the old receiver 18 has a pivot pin diameter of 0.375 inches. The new pivot pin 36 diameter can be increased or decreased to prevent rifle barrels from being coupled to the receiver 14. The presently preferred embodiment increases the diameter of the new pivot pin 36 to 0.425 inches. Likewise, the diameter could also be decreased to 0.325 inches to achieve the same result.

A last modification to the receiver 14 is provided in order to couple a portion of the new trigger assembly to the receiver. Specifically, a slot 38 and a small hole 40 are drilled into the bottom of the receiver. The slot 38 is provided in order to enable the insertion of a new trigger. The hole 40 is disposed through the slot 38 so that the new trigger is free to pivot within the slot, while being held in place by a pin through the hole.

While modifications to the receiver 14 are obviously critical to the success of the present invention, there are other details of the pistol that must also be considered. These details include explaining 1) a method of mounting the mid-grip stock 12 to the receiver, 2) detail about the recoil lug, 3) the new trigger assembly, and 4) a method of mounting the forearm stock 8 to the barrel.

Figure 3:
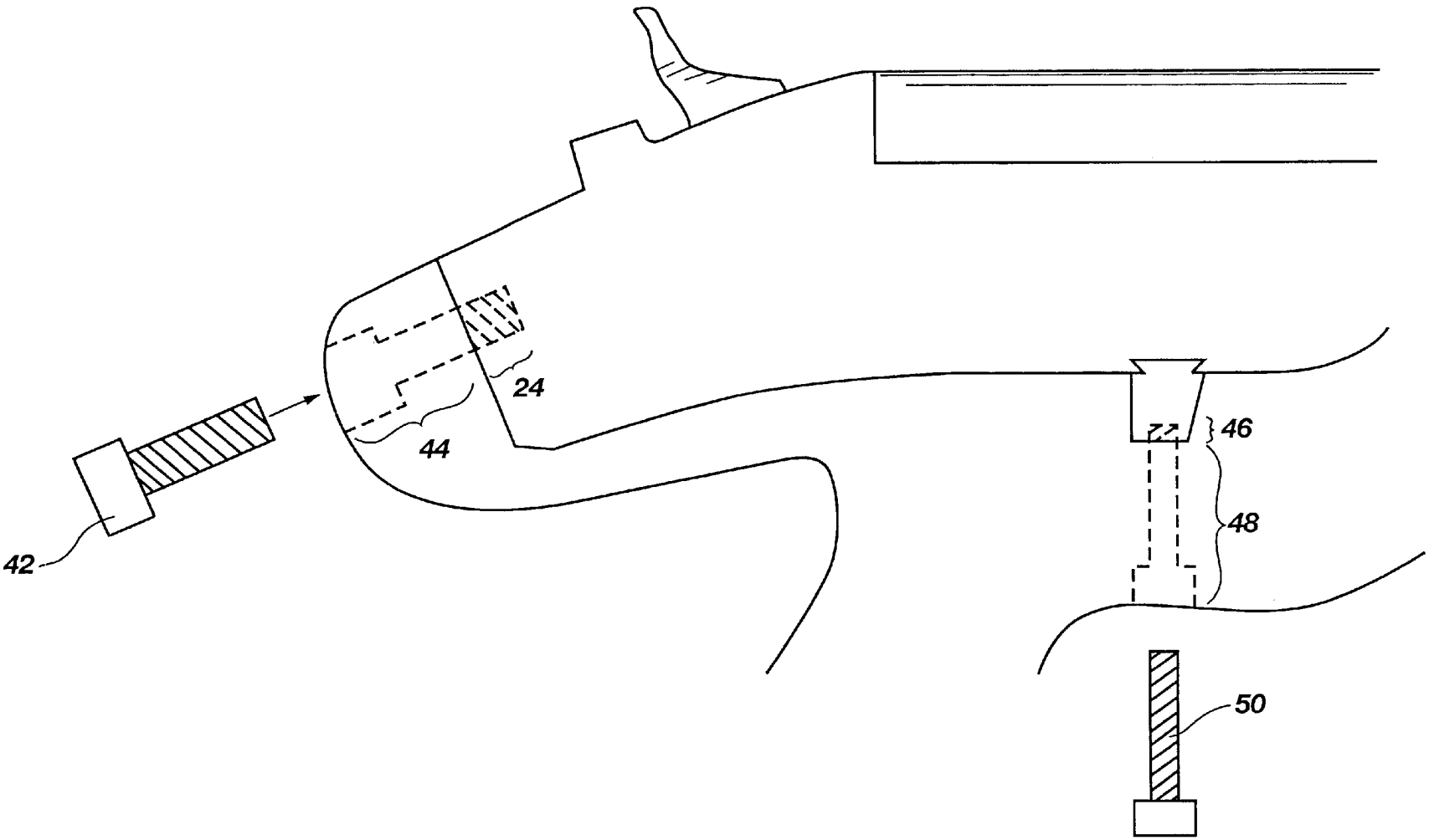
FIG. 3 is an elevational profile view of a rear portion of the pistol of the present invention, showing where mounting screws couple the mid-grip stock to the receiver.

The presently preferred embodiment for mounting the mid-grip stock 12 to the receiver 14 comprises two attachment points. The first attachment point has been previously described as a new mounting screw 42. FIG. 3 illustrates how a first mounting screw 42 is coupled to the threaded hole 24. A hole 44 is also disposed in the end of the mid-grip stock 12 for the first mounting screw 42. The hole 44 is also countersunk so that the first mounting screw 42 is hidden below the surface of the mid-grip stock 12. The first mounting screw 42 is approximately 1.75 inches long, has a head with a thickness of 0.25 inches, and is ⅜ inch NFT.

The second attachment point between the mid-grip stock 12 and the receiver 14 occurs at the recoil lug 32. Accordingly, the recoil lug 32 provides the added benefit of serving as an attachment point to the receiver 14, without having to modify the receiver 14 even more. A small threaded hole 46 is cut into the bottom end of the recoil lug 32. A hole 48 is also drilled through the mid-grip stock 12. The hole 48 is countersunk to hide a second mounting screw 50 below the surface of the mid-grip stock 12. The second mounting screw 50 is approximately 1.25 inches long, has a head that is approximately 0.125 inches thick, and is ¼ inch NFT.

Figure 4A:
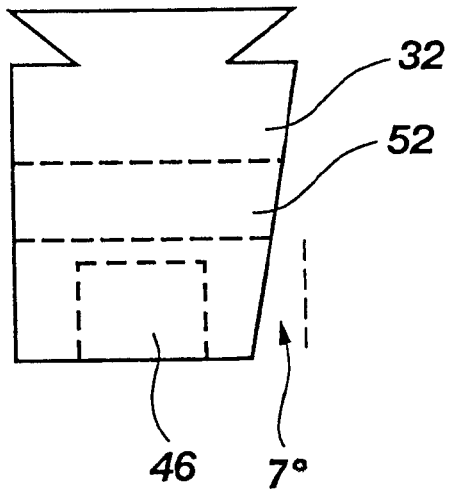
FIG. 4A is an elevational profile view of the recoil lug of the presently preferred embodiment.
Figure 4B:
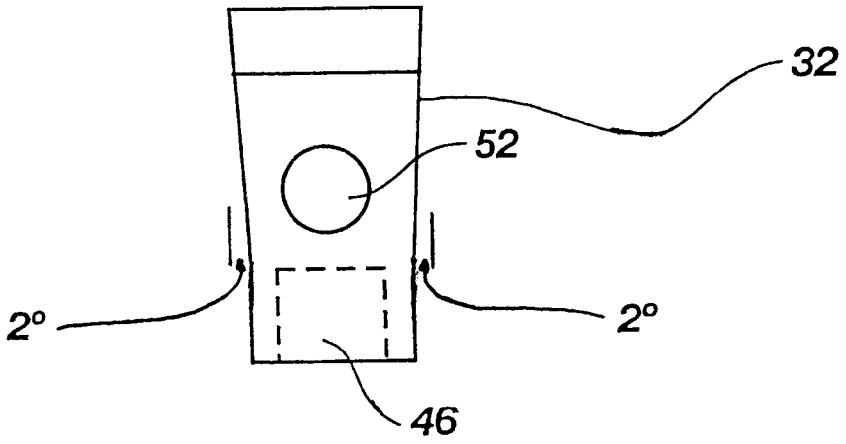
FIG. 4B is an elevational end view of the recoil lug of FIG. 4A.

FIGS. 4A and 4B provide more detail of the recoil lug 32. The dimensions of the recoil lug 32 are provided for the presently preferred embodiment, but they may be modified as appropriate for a particular rifle receiver and trigger assembly. As shown in these figures, the recoil lug 32 is approximately 0.50 inches long, and 1.375 inches wide. The recoil lug 32 includes a threaded hole 46 for the second mounting screw 50, and a hole 52 that is large enough for a trigger extension bar of the trigger assembly to pass through. Note that the recoil lug is tapered at approximately a 7° angle inwards on the front end, and is tapered at approximately a 2° angle inwards on either side.

Figure 5A:
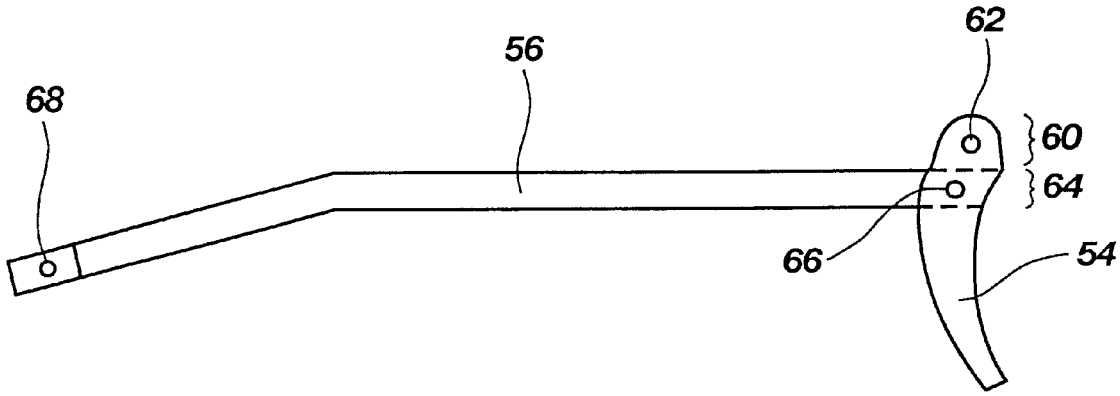
FIG. 5A is an elevational profile view of the new trigger assembly of the presently preferred embodiment.
Figure 5B:
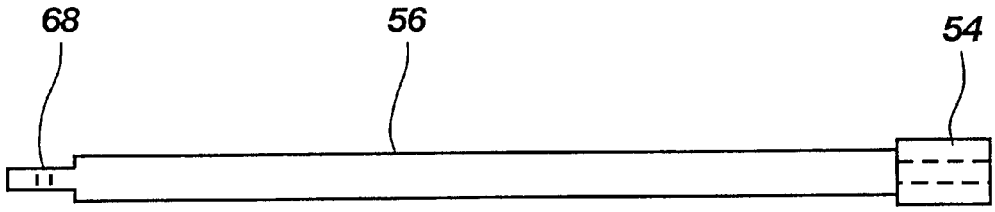
FIG. 5B is an elevational top view of the new trigger assembly shown in FIG. 5A.

The new trigger assembly of the present invention is simple and yet effective and reliable. FIGS. 5A and 5B show a profile view and a top view, respectively, of a trigger 54 and a trigger extension bar 56. In FIG. 5A, the trigger 54 has a top portion 60 that slides into the slot in the bottom of the receiver 14. A hole 62 enables a roll pin to be pivotally engaged to the receiver 14.

Just beneath the top portion 60 is a slotted portion 64 of the trigger 54. The slotted portion 64 is provided so that the trigger extension bar 56 can be coupled to the trigger 54. A hole 66 through the slotted portion 64 enables the trigger extension bar 56 to pivotally engage the trigger 54 by inserting a roll pin therein.

The trigger extension bar 56 is generally round except at the ends, is approximately 3.75 inches long, and is bent at approximately a 7° angle near a midpoint thereof. The ends of the trigger extension bar are flattened in a vertical orientation so that they can slide into slots that are formed in the original trigger 28 and the new trigger 54. Therefore, approximately 0.275 inches from the end that is coupled to the original trigger 28, the trigger extension bar 56 is narrowed, with a hole 68 disposed therethrough.

FIG. 5B shows that the trigger extension bar 56 is approximately 0.175 inches in diameter, and that the new trigger 54 is approximately 0.30 inches wide.

Figure 6:
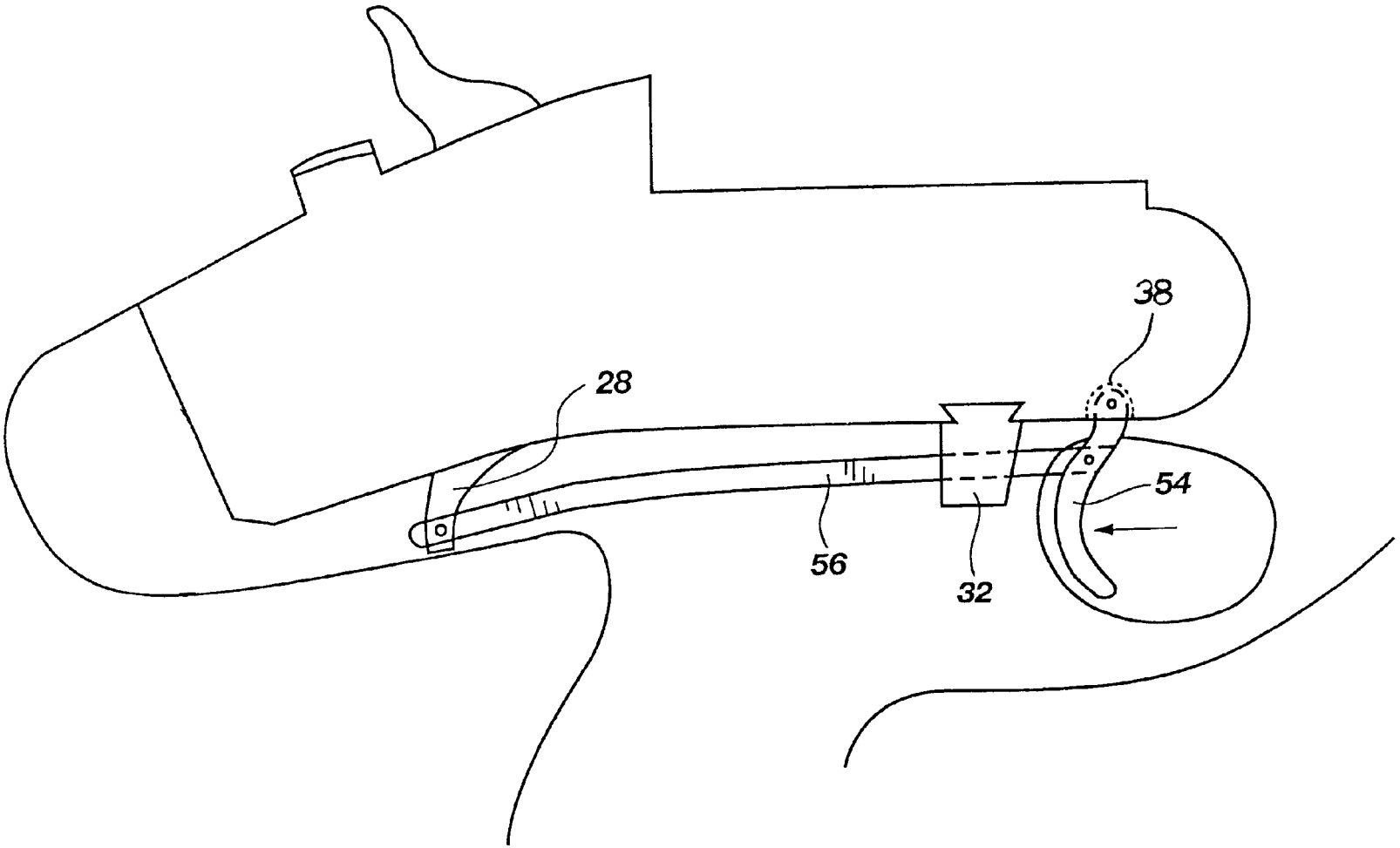
FIG. 6 is a close-up and elevational profile view of the new trigger assembly installed on the modified rifle receiver of the presently preferred embodiment.

FIG. 6 is provided as a cut-away elevational profile view to illustrate the operation of the new trigger assembly inside the mid-grip stock 12. The trigger assembly is comprised of the trigger 54, the trigger extension bar 56, and the recoil lug 32. As a finger pulls back on the trigger 54 which pivots in slot 38, the components having roll pins pivot, while the trigger extension bar slides backwards through the recoil lug 32, and pushes the original trigger 28 backwards, thereby discharging the pistol.

Figure 7A:
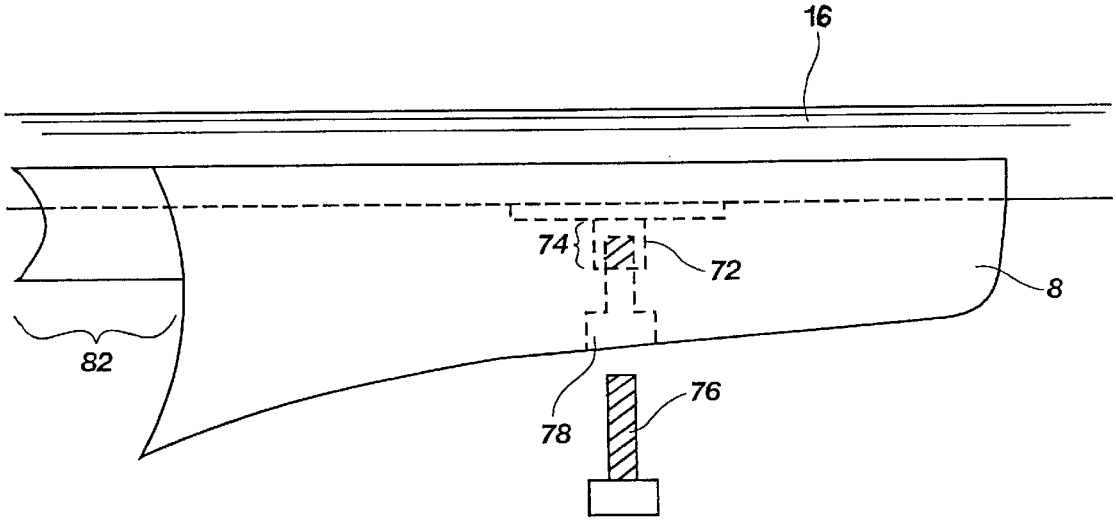
FIG. 7A is an elevational profile view of the barrel forearm lug, the forearm stock, and the barrel of the presently preferred embodiment.

FIG. 7A is provided to illustrate the forearm stock 8. It is important to realize that this forearm stock 8 is unique in that it is not an integral part of the mid-grip stock 12. It is coupled directly to the pistol barrel. This arrangement is necessary so that when the barrel 16 is pivoted forwards to insert a round into the firing chamber, the forearm stock 8 slides along an outer edge of the mid-grip stock 12. This pivoted forward position is shown in FIG. 7C.

The forearm stock 8 is shown in cut-away to show how it is coupled to the barrel 16 along a length thereof. The means for attaching them together is a barrel forearm lug 72 that is disposed approximately 7.5 inches from the end of the receiver 14. The purpose for varying a point of attachment of the barrel forearm lug 72 to the barrel 16 is to prevent the use of a rifle barrel with the pistol.

Figure 7B:
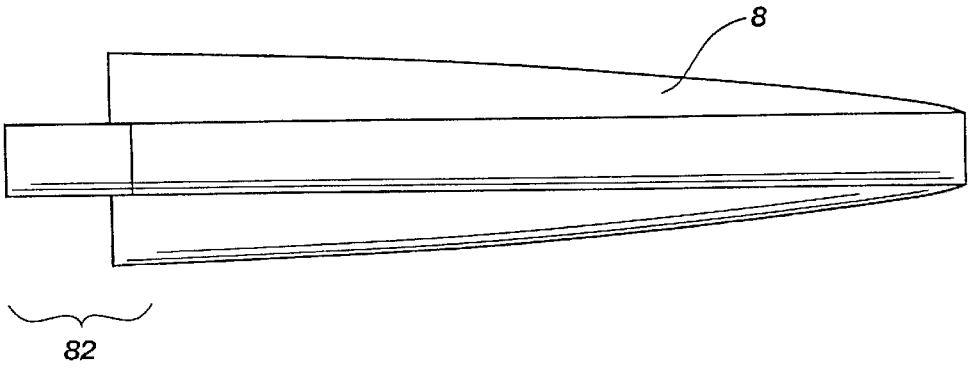
FIG. 7B is an elevational top view of the barrel stock used in FIG. 7A.
Figure 7C:
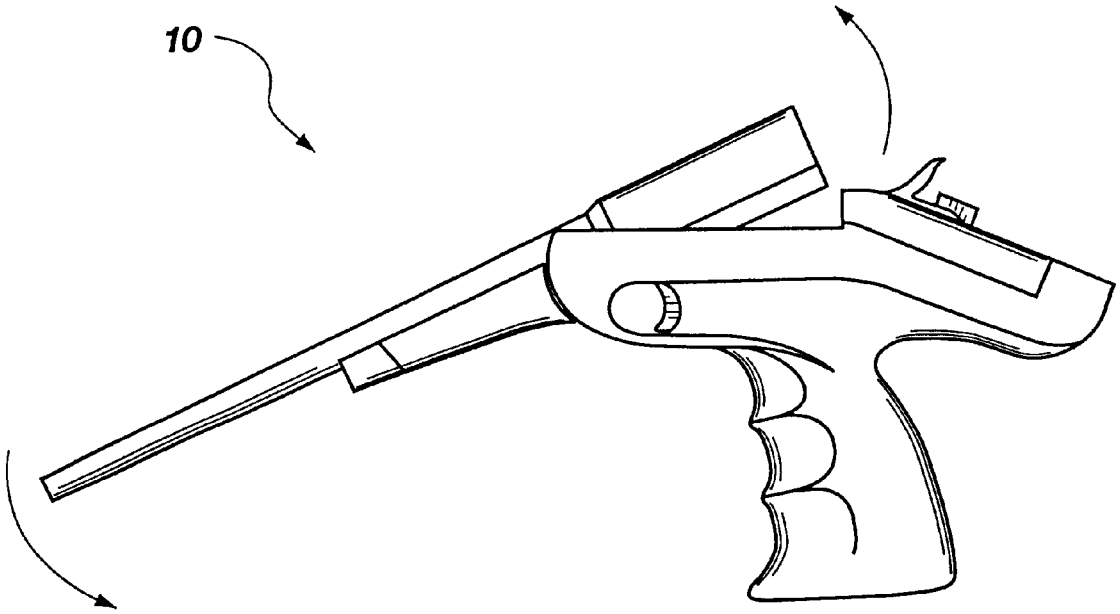
FIG. 7C is an elevational profile view showing how the forearm stock and the barrel pitch forward for the break-action rifle receiver.

FIG. 7B is a top view of the forearm stock 8 that has been modified to function with the present invention. Specifically, note an extension 82 of the forearm stock 8. This extension 82 is disposed up against the curved outer edge 84 (see FIG. 2B) of the receiver 14.

The barrel forearm lug 72 has a threaded hole 74 therein. A third mounting screw 76 couples the forearm stock 8 to the barrel forearm lug 72 via the third mounting screw 76. A hole 78 in the forearm stock 8 is countersunk to keep the end of the third mounting screw 76 from extending beyond the hole 78.

It is noted that the barrel 70 used in the preferred embodiment is also from New England Firearms. Advantageously, it is noted that other pistol barrels can be substituted for the barrel shown in FIG. 7. However, these other barrels must either have an attachment point at a same place along the barrel, or be modified by coupling an attachment at the same place.

It is also noted that the preferred barrel length extends up to fifteen inches. It is understood that a pistol can have a barrel whose length does not exceed 16 inches. Nevertheless, it has already been explained that the position of the barrel forearm lug 72, and the new diameter of the pivot pin 36 are designed to prevent use of rifle barrels.

Figure 8:
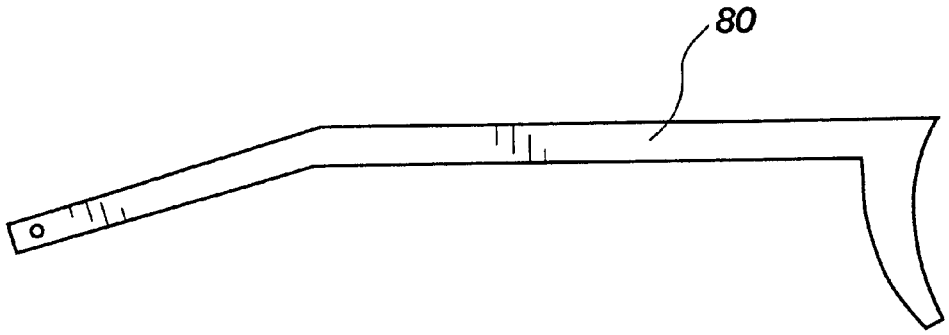
FIG. 8 is an elevational profile view of an alternative embodiment of a trigger assembly that can be used with the present invention.

There can be many modifications to the presently preferred embodiment, all of which will result in a mid-grip high-powered pistol that utilizes the principles of the invention. For example, consider FIG. 8. FIG. 8 shows another design of a trigger assembly that can be used in place of the preferred embodiment shown in FIGS. 5A and 5B. In the preferred embodiment, the extension bar 56 is separate from the trigger itself 54. Furthermore, they pivot with respect to each other because of hole 66 and a pivot pin inserted therein.

In the alternative embodiment, the extension bar is made integral with or is coupled to the trigger so that they function as a single unit that does not pivot. Thus, this trigger would simply move back as a single unit against a trigger guard. While this action is not the same as a typical trigger that pivots, it would accomplish the same purpose, which is to actuate the original trigger.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A mid-grip pistol that is created by modifying a rifle receiver, said pistol comprising:

a rifle receiver, wherein a rifle stock is removed from the rifle receiver, and wherein the rifle receiver is modified to include:

a trigger assembly, wherein the trigger assembly is disposed in front of an original trigger, and wherein a portion of an original trigger guard is removed from around the original trigger to thereby enable the trigger assembly to be coupled to the original trigger for actuation thereby;

a recoil lug that is coupled to the rifle receiver so as to absorb the shock of recoil, wherein the recoil lug is disposed between the trigger assembly and the original trigger;

a mid-grip pistol stock that is coupled to the rifle receiver so as to enable the trigger assembly to be actuable through a new trigger guard therein; and a pistol barrel that is coupled to the rifle receiver.

2. The mid-grip pistol as defined in claim 1 wherein The recoil lug further comprises a metal lug disposed so as to extend downward from a bottom edge of the rifle receiver, near a pivot pin thereof.

3. The mid-grip pistol as defined in claim 2 wherein the recoil lug further comprises a dovetail cut, wherein the recoil lug is coupled to a complementary cut made in the bottom edge of the rifle receiver.

4. The mid-grip pistol as defined in claim 3 wherein the recoil lug further comprises an aperture disposed from a front end to a back end, thereby enabling a portion of the trigger assembly to be disposed therethrough in sliding engagement.

5. The mid-grip pistol as defined in claim 4 wherein the recoil lug further comprises:

a threaded hole disposed in a bottom end of the recoil lug; and a mounting screw, wherein the mounting screw is disposed into the mid-grip pistol stock and coupled to the threaded hole, thereby coupling the mid-grip pistol stock to the rifle receiver.

6. The mid-grip pistol as defined in claim 5 wherein the recoil lug further comprises:

a back side that is cut generally perpendicular to the bottom edge of the rifle receiver; and a front side that is cut inwards towards the back side at an angle that is less than 90 degrees with respect to the bottom edge of the rifle receiver.

7. The mid-grip pistol as defined in claim 4 wherein the trigger assembly further comprises a trigger that is disposed in front of the recoil lug, wherein the rifle receiver includes a slot therein, wherein the trigger is narrow on a top edge thereof to fit in pivoting engagement with the slot in the rifle receiver, wherein a hole in the top edge of the trigger engages a roll pin that is inserted through the rifle receiver.

8. The mid-grip pistol as defined in claim 7 wherein the trigger assembly further comprises a trigger extension bar that is pivotally engaged at a first end to the trigger, and is pivotally engaged at a second end to the original trigger.

9. The mid-grip pistol as defined in claim 8 wherein the trigger assembly further comprises:

a slot disposed in the trigger;

a hole disposed through the trigger from side to side and through the slot, wherein the first end of the trigger extension bar is disposed within the slot in the trigger, and wherein a roll pin is disposed through the hole of the trigger and through a hole in the trigger extension bar to thereby enable the pivotal engagement;

a slot disposed in the original trigger; and a hole disposed through the original trigger from side to side and through the slot, wherein the second end of the trigger extension bar is disposed within the slot in the original trigger, and wherein a roll pin is disposed through the hole of the original trigger and through a hole in the trigger extension bar to thereby enable the pivotal engagement.

10. The mid-grip pistol as defined in claim 9 wherein the trigger assembly further comprises disposing the trigger extension bar from the original trigger to the trigger by passing the trigger extension bar through the aperture in the recoil lug.

11. The mid-grip pistol as defined in claim 9 wherein the rifle receiver further comprises a shortened original trigger to thereby prevent interference with the mid-grip pistol stock.

12. The mid-grip pistol as defined in claim 1 wherein the rifle receiver further comprises:

a rear portion that is squared off relative to a top edge thereof, and wherein a wedge shaped portion is removed from a bottom rear corner of the rear portion of the rifle receiver; and a threaded mounting screw hole disposed into a back end of the rifle receiver, to thereby form a location to anchor the mid-grip pistol stock to the rifle receiver.

13. The mid-grip pistol as defined in claim 1 wherein the rifle receiver further comprises a pivot pin having a larger diameter than an existing pivot pin in the rifle receiver, and disposed in a same location as the existing pivot pin, to thereby prevent coupling a rifle barrel to the rifle receiver.

14. The mid-grip pistol as defined in claim 1 wherein the rifle receiver further comprises a pivot pin having a smaller diameter than an existing pivot pin in the rifle receiver, and disposed in a same location as the existing pivot pin, to thereby prevent coupling a rifle barrel to the rifle receiver.

15. The mid-grip pistol as defined in claim 1 wherein the rifle receiver further comprises:

a forearm stock;

a forearm lug disposed on an underside of the pistol barrel; and a mounting screw, wherein the forearm stock is coupled to the pistol barrel by inserting the mounting screw into the forearm stock and coupling to the forearm lug.

16. The mid-grip pistol as defined in claim 4 wherein the rifle receiver further comprises:

a trigger that is disposed in front of the recoil lug; and a trigger extension bar that is pivotally engaged at a first end to the original trigger, and is rigidly coupled at a second end to the trigger, wherein the trigger extension bar is also disposed through the aperture in the recoil lug.

17. A mid-grip pistol that is created by modifying a rifle receiver, said pistol comprising:

a rifle receiver, wherein a rifle stock is removed therefrom, wherein a rear portion is squared off relative to a top edge thereof, and wherein a wedge shaped portion is removed from a bottom rear corner of the rear portion of the rifle receiver, a threaded mounting screw hole disposed into a back end of the rifle receiver, to thereby form a location to anchor a mid-grip pistol stock to the rifle receiver, wherein the rifle receiver further comprises a pivot pin having a larger diameter than an existing pivot pin in the rifle receiver, and wherein the rifle receiver is modified to include:

a trigger assembly, wherein the trigger assembly is disposed in front of an original trigger, and wherein an original trigger guard is removed from around the original trigger to thereby enable the trigger assembly to be coupled to the original trigger for actuation thereby;

a recoil lug that is coupled to the rifle receiver so as to absorb the shock of recoil, wherein the recoil lug is disposed between the trigger assembly and the original trigger;

the mid-grip pistol stock that is coupled to the rifle receiver at the threaded mounting screw hole so as to enable the trigger assembly to be actuable through a new trigger guard therein; and a pistol barrel that is coupled to the rifle receiver.

18. A method for modifying a rifle receiver to create a mid-grip pistol, said method comprising the steps of:

(1) removing a rifle stock from a rifle receiver, and removing an original trigger guard from around an original trigger;

(2) coupling a trigger assembly to the rifle receiver in front of the original trigger;

(3) coupling a recoil lug to the rifle receiver so as to absorb the shock of recoil, wherein the recoil lug is disposed between the trigger assembly and the original trigger to enable high absorption of the recoil, and wherein the trigger assembly is coupled to the original trigger through an aperture disposed through the recoil lug;

(4) coupling a mid-grip pistol stock to the rifle receiver so as to enable the trigger assembly to be actuable through a new trigger guard disposed therein; and (5) coupling a pistol barrel to the rifle receiver.

19. The method as defined in claim 18 wherein the method further comprises the step of disposing the recoil lug on a bottom edge of the rifle receiver so as to extend downward therefrom, near a pivot pin of the rifle receiver, and opposite a rear of the rifle receiver.

20. The method as defined in claim 19 wherein the method further comprises the step of coupling the recoil lug to the rifle receiver utilizing a dovetail cut into the recoil lug, which is coupled to a complementary cut made in the bottom edge of the rifle receiver.

21. The method as defined in claim 20 wherein the method further comprises the steps of:

(1) providing a threaded hole in a bottom end of the recoil lug; and (2) coupling the mid-grip pistol stock to the rifle receiver utilizing a mounting screw disposed through the mid-grip pistol stock and into the threaded hole.

22. The method as defined in claim 21 wherein the method further comprises the steps of:

(1) providing the recoil lug with a back side that is cut generally perpendicular relative to the bottom edge of the rifle receiver; and (2) providing the recoil lug with a front side that is cut inwards towards the back side at an angle that is less than 90 degrees with respect to the bottom edge of the rifle receiver.

23. The method as defined in claim 22 wherein the method further comprises the steps of:

(1) forming a slot in the rifle receiver, wherein the trigger is narrow on a top edge thereof to fit in pivoting engagement with the slot in the rifle receiver; and (2) forming a hole in the top edge of the trigger to thereby engage a roll pin that is inserted through the rifle receiver.

24. The method as defined in claim 23 wherein the method further comprises the steps of:

(1) pivotally engaging a first end of a trigger extension bar to the trigger; and (2) pivotally engaging a second end of a trigger extension bar to the original trigger.

25. The method as defined in claim 24 wherein the method further comprises the steps of:

(1) disposing a slot in the trigger;

(2) disposing a hole through the trigger from side to side and through the slot, wherein the first end of the trigger extension bar is disposed within the slot in the trigger;

(3) disposing a roll pin through the hole of the trigger and through a hole in the trigger extension bar to thereby enable the pivotal engagement;

(4) disposing a slot in the original trigger;

(5) disposing a hole through the original trigger from side to side and through the slot, wherein the second end of the trigger extension bar is disposed within the slot in the original trigger; and (6) disposing a roll pin through the hole of the original trigger and through a hole in the trigger extension bar to thereby enable the pivotal engagement.

26. The method as defined in claim 25 wherein the method further comprised the step of disposing the trigger extension bar from the original trigger to the trigger by passing the trigger extension bar through the aperture in the recoil lug.

27. The method as defined in claim 26 wherein the method further comprises the step of shortening the original trigger to thereby prevent interference with the mid-grip pistol stock.

28. The method as defined in claim 18 wherein the method further comprises the steps of:

(1) squaring off a rear portion of the rifle receiver relative to a top edge thereof;

(2) removing a wedge shaped portion from a bottom rear corner of the rear portion of the rifle receiver; and (3) disposing a threaded mounting screw hole into a back end of the rifle receiver, to thereby form a location to anchor the mid-grip pistol stock to the rifle receiver.

29. The method as defined in claim 18 wherein the method further comprises the step of providing a pivot pin having a larger diameter than an existing pivot pin in the rifle receiver, and disposed in a same location as the existing pivot pin, to thereby prevent coupling a rifle barrel to the rifle receiver.

30. The method as defined in claim 18 wherein the method further comprises the step of providing a pivot pin having a smaller diameter than an existing pivot pin in the rifle receiver, and disposed in a same location as the existing pivot pin, to thereby prevent coupling a rifle barrel to the rifle receiver.

31. The method as defined in claim 18 wherein the method further comprises the steps of:

(1) providing a forearm stock;

(2) providing a forearm lug disposed on an underside of the pistol barrel; and (3) coupling the forearm stock to the pistol barrel utilizing a mounting screw that is inserted through the forearm stock and into the forearm lug.

32. The method as defined in claim 24 wherein the method further comprises the steps of:

(1) disposing a trigger in front of the recoil lug; and (2) providing a trigger extension bar that is pivotally engaged at a first end to the original trigger, and is rigidly coupled at a second end to the trigger, wherein the trigger extension bar is also disposed through the aperture in the recoil lug.

* * * * *